US009437935B2

(12) United States Patent
DeLuis et al.

(10) Patent No.: US 9,437,935 B2
(45) Date of Patent: Sep. 6, 2016

(54) DUAL BAND ANTENNA PAIR WITH HIGH ISOLATION

(71) Applicant: Microsoft Corporation, Redmond, WA (US)

(72) Inventors: Javier R. DeLuis, Kirkland, WA (US); Alireza Mahanfar, Bellevue, WA (US); Benjamin Shewan, Redmond, WA (US); Mark Casebolt, Seattle, WA (US); Jeff Reents, Carnation, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 154 days.

(21) Appl. No.: 13/779,697

(22) Filed: Feb. 27, 2013

(65) Prior Publication Data

US 2014/0242903 A1 Aug. 28, 2014

(51) Int. Cl.

| | |
|---|---|
| ***H01Q 21/28*** | (2006.01) |
| ***H01Q 1/52*** | (2006.01) |
| ***H01Q 21/24*** | (2006.01) |

(52) U.S. Cl.

CPC ..... *H01Q 21/28* (2013.01); *H01Q 1/521* (2013.01); *H01Q 21/24* (2013.01)

(58) Field of Classification Search

None

See application file for complete search history.

(56) References Cited

U.S. PATENT DOCUMENTS

| | | | | |
|---|---|---|---|---|
| 5,329,067 | A * | 7/1994 | Abe et al. | 174/260 |
| 5,952,983 | A | 9/1999 | Dearnley et al. | |
| 6,025,812 | A | 2/2000 | Gabriel et al. | |
| 6,426,723 | B1 | 7/2002 | Smith et al. | |
| 6,624,790 | B1 * | 9/2003 | Wong et al. | 343/702 |
| 7,710,343 | B2 | 5/2010 | Chiu et al. | |
| 8,077,095 | B2 | 12/2011 | Suh et al. | |
| 8,115,686 | B2 | 2/2012 | Mumbru et al. | |
| 8,750,798 | B2 * | 6/2014 | Rao et al. | 455/41.2 |
| 2002/0030628 | A1 * | 3/2002 | Tsai | 343/702 |
| 2005/0130743 | A1 * | 6/2005 | Leifer | 463/39 |
| 2008/0204347 | A1 * | 8/2008 | Alvey et al. | 343/841 |
| 2009/0009400 | A1 | 1/2009 | Kim et al. | |
| 2010/0103066 | A1 | 4/2010 | Shtrom et al. | |
| 2010/0119002 | A1 | 5/2010 | Hartenstein | |
| 2011/0205134 | A1 * | 8/2011 | Blumberg, Jr. | 343/753 |

OTHER PUBLICATIONS

Wikipedia, Microstrip antenna, 2011 https://web.archive.org/web/20111020072018/http://en.wikipedia.org/wiki/Microstrip_antenna.*

(Continued)

*Primary Examiner* — Ping Hsieh
*Assistant Examiner* — James Yang
(74) *Attorney, Agent, or Firm* — Gregg Wisdom; Judy Yee; Micky Minhas

(57) ABSTRACT

A dual band printed antenna pair operates simultaneously at both WLAN frequency bands (2.4 GHz/5 GHz). The antenna pair provides high isolation between both antennas while having an efficient over the air performance. The antenna pair achieve greater than 20 dB isolation at 2.4 GHz and 5 GHz band, while having antennas positioned in close proximity. The high isolation is accomplished using an orthogonal antenna configuration (exploiting orthogonal polarization) and a parasitic element to further enhance isolation at 2.4 GHz. The antenna pair and parasitic element are printed on a Printed Circuit Board (PCB) adding relatively little cost to the Radio Frequency (RF) interface. The PCB is then fixed on top of a metal chassis with the antenna keep out area overhanging a corner of the metal chassis to enhance performance.

21 Claims, 9 Drawing Sheets

(56) References Cited

OTHER PUBLICATIONS

Motorola, AP-7131 Spec, 2011 http://www.motorolasolutions.com/web/Business/Products/Wireless%20LAN%20Devices/WLAN%20Access%20Points/AP-7131/__Documents/__staticfiles/AP-7131__Spec-Sheet__0910-web.pdf.*

Kim, et al., "High Isolation Internal Dual-Band Planar Inverted-F Antenna Diversity System with Band-Notched Slots for MIMO Terminals", In Proceedings of 36th European Microwave Conference, Sep. 10, 2006, 4 pages.

Li, et al., "A Dual Polarization Slot Antenna Using a Compact CPW Feeding Structure", In IEEE Antennas and Wireless Propagation Letters, vol. 9, Mar. 8, 2010, 4 pages.

"International Search Report & Written Opinion for PCT Patent Application No. PCT/US2014/017878", Mailed Date: Jun. 18, 2014, Filed Date: Feb. 24, 2014, 11 Pages.

PCT Demand for International Preliminary Examination and Response to International Search Report & Written Opinion filed Sep. 24, 2014 in International Patent Application No. PCT/US2014/017878.

* cited by examiner

DUAL BAND ANTENNA PAIR WITH HIGH ISOLATION

BACKGROUND

Wireless Local Area Networks (WLANs) are used for providing users with access to services and/or network connectivity. WLANs typically follow sets of standards described in the Institute of Electrical and Electronics Engineers (IEEE) 802.11. WLANs may operate in an unlicensed Industrial, Scientific and Medical (ISM) region of the frequency spectrum. For most countries, the communication channels in these bands are located between 2.41 Gigahertz (GHz) and 2.48 GHz (known as 2.4 GHz band or 2.4 GHz) or between 5.17 GHz and 5.82 GHz (known as 5 GHz band or 5 GHz).

The dual band nature of several IEEE 802.11x standards requires antennas to operate at both frequency bands. Additionally, other standards require the use of multiple input multiple output (MIMO) antennas where several transmitting/receiving antennas are operating simultaneously to achieve higher data rates.

SUMMARY

A dual band printed antenna pair operates simultaneously at both WLAN frequency bands (2.4 GHz/5 GHz). The antenna pair provides high isolation between both antennas while having an efficient over the air performance. The antenna pair achieve greater than 20 dB isolation at 2.4 GHz and 5 GHz band, while having antennas positioned in close proximity. The high isolation is accomplished using an orthogonal antenna configuration (exploiting orthogonal polarization) and a parasitic element to further enhance isolation at 2.4 GHz. The antenna pair and parasitic element are printed on a Printed Circuit Board (PCB) adding relatively little cost to a Radio Frequency (RF) interface. The PCB is then fixed on top of a metal chassis with the antenna keep out area overhanging a corner of the metal chassis to enhance performance.

In other embodiments, additional antennas operating in other frequency bands and/or additional parasitic elements may be used to provide isolation.

In an embodiment, an apparatus comprises a substrate having first and second sides. A first antenna is disposed on the first side of the substrate. A second adjacent antenna is disposed on the second side of the substrate. A parasitic element is disposed between the first and second antennas. The first and second antennas are disposed on the first and second sides of the substrate such that the radiation from the first and second antennas has orthogonal polarization. The parasitic element also forms an electrical field to further provide isolation between the first and second antennas.

A method embodiment includes operating a multi-band wireless wide area network antenna having a parasitic element. The method comprises transmitting from a first antenna a first signal at a first frequency in a first range of frequencies. A second signal is transmitted at a second frequency in a second range of frequencies from a second antenna, while the first antenna is transmitting the first signal. The second signal is transmitted orthogonal to the first signal to form isolation. A current is generated through the parasitic element in response to at least transmission from one of the first and second antennas. The current forms an electric field to further isolate the first and second signals.

In another apparatus embodiment, the apparatus includes a PCB having a ground plane. The PCB has a first side and adjacent second side. A first microstrip antenna is disposed on the first side and radiates a first signal in first range of frequencies. A second microstrip antenna is disposed on the second side. The second microstrip antenna radiates a second signal in a second range of frequencies that is orthogonal to the first signal. A parasitic element is disposed between the first and second antennas. The parasitic element is coupled to the ground plane and generates an electronic isolation field in response to at least one of the first and second antennas radiating the first and second signals. A processor readable memory stores processor readable instructions and at least one processor executes the processor readable instructions to output a third and fourth signals to the first and second microstrip antennas. The third signal represent first information to access a network such that the first microstrip antenna radiates the first signal that includes the first information to access the network. The fourth signal represents second information to access the network such that the second microstrip antenna radiates the second signal that includes the second information to access the network.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

In order to maximize a benefit of using at least two antennas (i.e. higher channel capacity and data rates), radiation coupling between the two antennas is relatively low (for example <20 dB) in an embodiment. In a computing device embodiment having a relatively small form factor in which space is limited, the separation between the antennas may not be easily increased. Yet, having antennas relatively closely spaced allows for proximity to a transceiver and avoid a use of long coaxial cables or strip lines. Therefore, it is desirable to have highly isolated antennas that are electrically close to each other in an embodiment.

Accordingly, key aspects of the present technology include at least a specific antenna topology having an orthogonal arrangement and a parasitic element that may allow for a close proximity arrangement and high isolation. The orthogonal arrangement takes advantage of orthogonal polarization to provide isolation and a parasitic element further enhances isolation between the antennas by forming an electrical isolation field. More antennas and/or parasitic elements may be used for additional frequency bands. Also, overhanging a PCB having the pair of antennas disposed on the sides from a metal chassis allows for efficient antenna performance without the use of antenna carriers.

Figure 1:
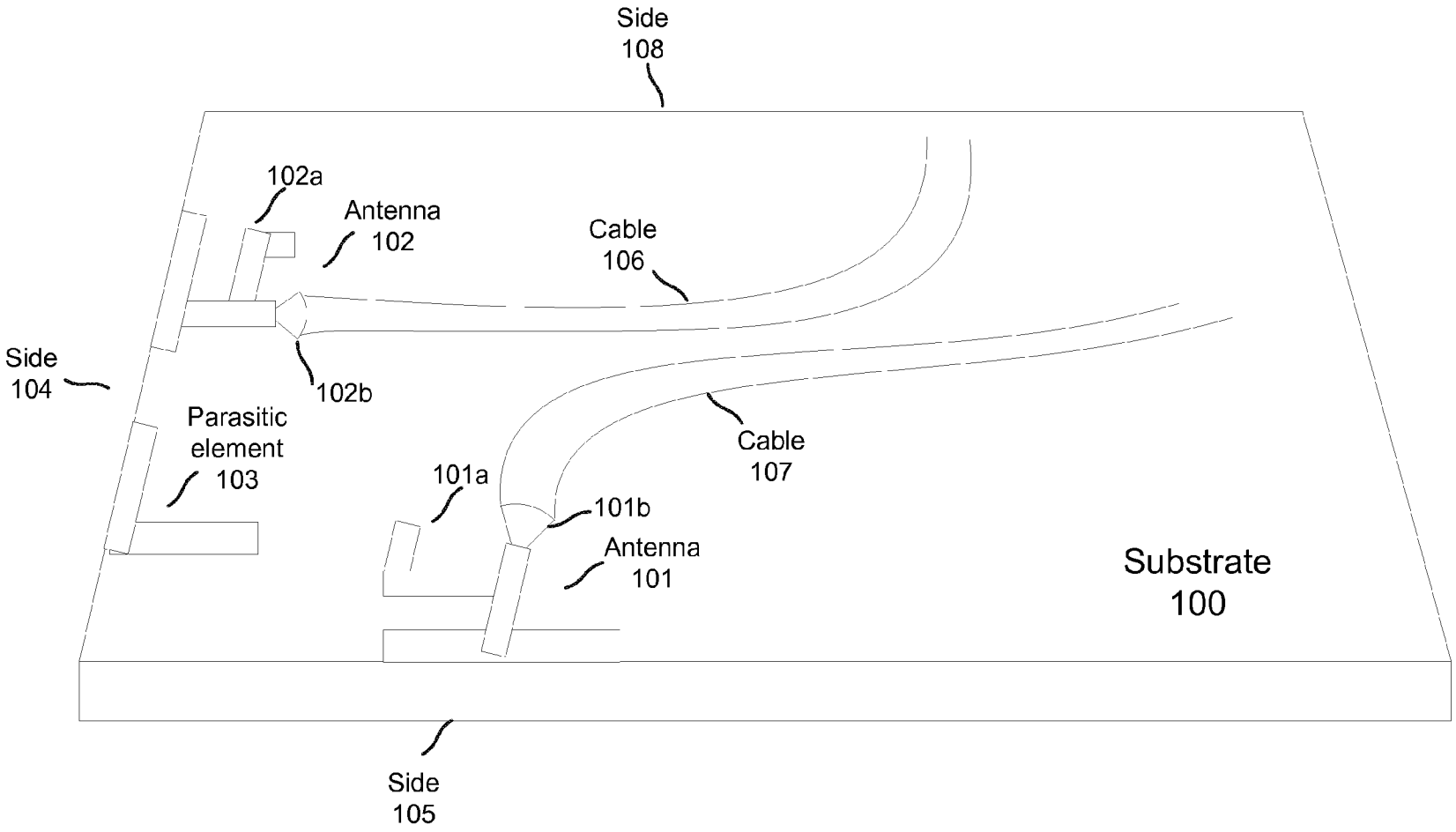
FIG. 1 is top view of a dual band antenna with high isolation.

FIG. 1 is top view of a dual band antenna having high isolation according to an embodiment. In particular, FIG. 1 illustrates antenna 102 disposed on a side 104 of substrate 100 and antenna 101 disposed on a side 105 of substrate 100. Side 105 is adjacent to side 104. In an embodiment, substrate 100 is a rectangular substrate having four sides forming ninety degree corners. In alternate embodiments, substrate 100 may be other geometrical shapes. In an embodiment, substrate 100 is approximately 54.5 mm (side 105) by approximately 79.2 mm (side 104).

In embodiments, antennas 101 and 102 may take on different geometric shapes. For example antennas 101 and 102 may have a single or multiple branches. Parasitic element 103, as described herein, may take on different geometric shapes as well. For example, parasitic element 103 may be formed in the shape of a capital letter L. In an embodiment, antennas 101 and 102 as well as parasitic element 103 have approximately the same length.

Figure 2:
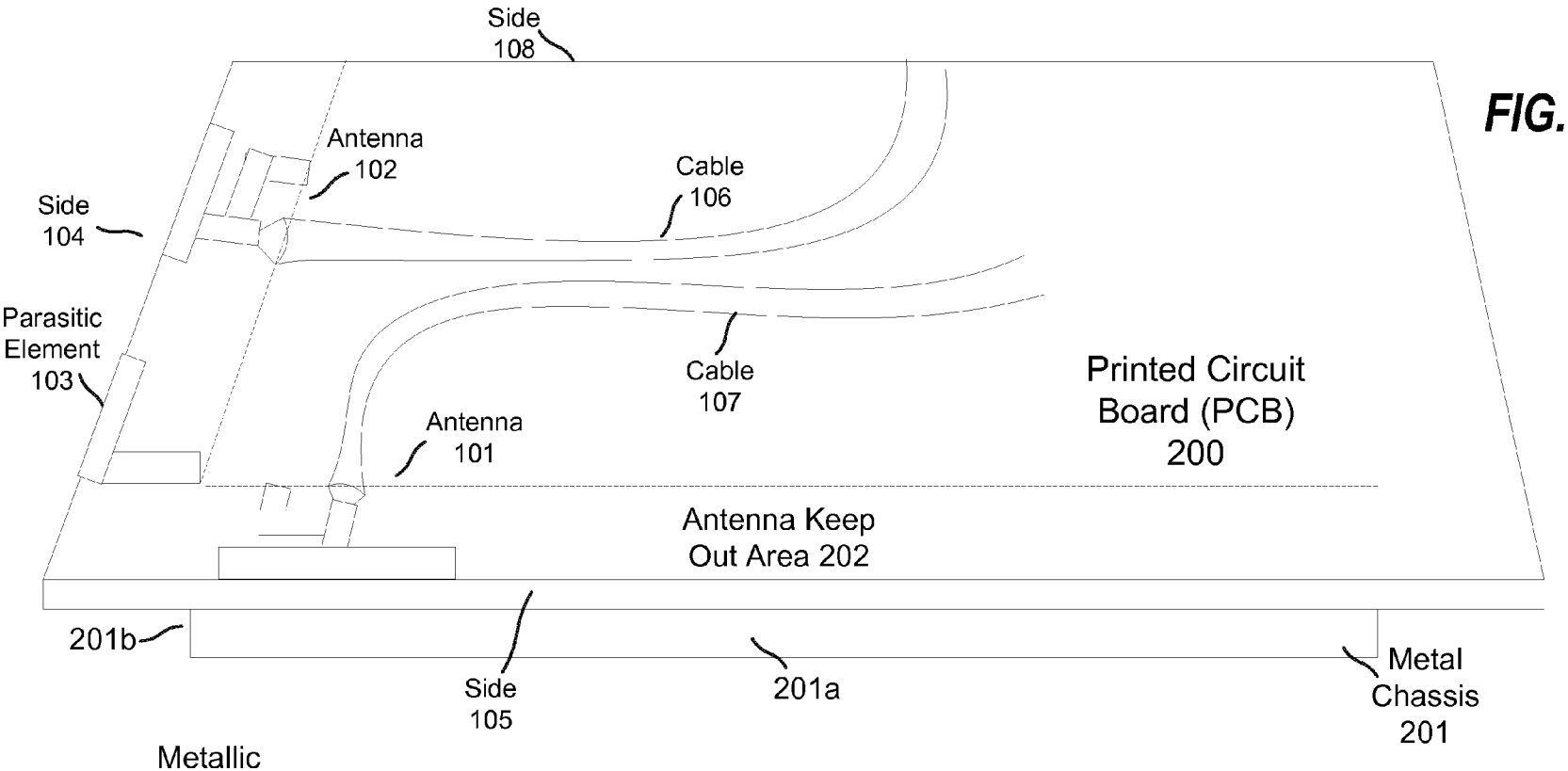
FIG. 2 is a top view of a dual band antenna with high isolation coupled to a metal chassis.

In an embodiment, signals are carried on cables 206 and 207 to antennas 101 and 102, as illustrated in FIG. 2, so that antennas 101 and 102 may radiate both WLAN frequency bands (2.4 GHz/5 GHz) simultaneously. In particular, cables 206 and 207 provide signals to and receive signals from feed points 101*b* and 102*b* of antennas 101 and 102, respectively. In embodiments, antennas 101 and 102 may also receive both WLAN frequency bands (2.4 GHz/5 GHz) simultaneously. In embodiments, antenna 101 receives a signal in a WLAN frequency band while antenna 102 radiates a signal in a WLAN frequency band. In an embodiment, cables 206 and 207 may be micro strips or other types of signal paths. In an embodiment, signals provided to and received by antennas 101 and 102 via cables 206 and 207 are provided by a transceiver in a radio frequency interface circuit and/or processor.

Figure 3:
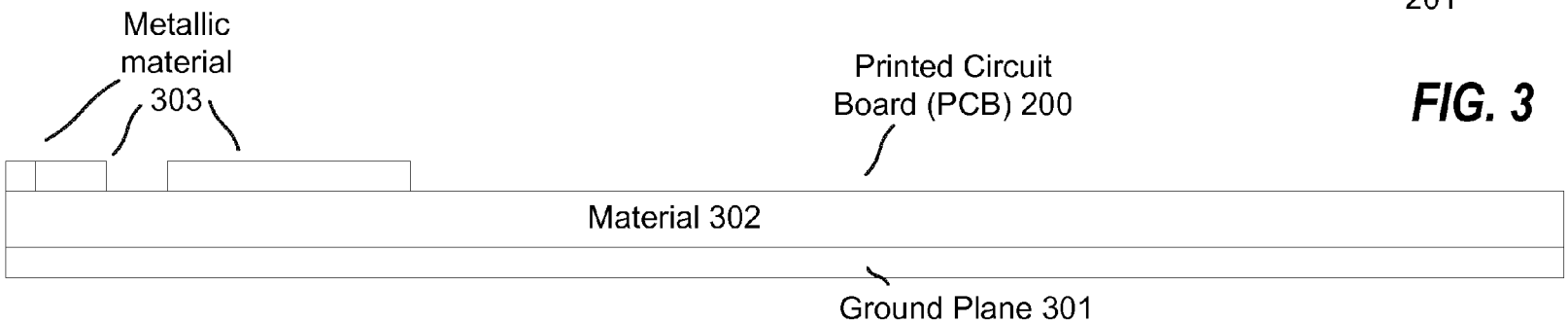
FIG. 3 is a side cross-section view of a PCB illustrated in FIG. 2.

In an embodiment, antennas 101 and 102 are microstrip patch antennas that are formed by printing metallic material or elements over a surface of substrate 100. In an embodiment, substrate 100 is a PCB 200 as illustrated in FIG. 3. PCB 200 includes a lower ground plane 301, material 302 and metallic material 303 that form antennas 101 and 102, or microstrip patch antennas, on top of a surface of material 302 and over ground plane 301 in an embodiment. The thickness of material 302 and ground plane 301 that supports metallic material 303 may vary. Material 302 may be air or typical PCB materials such as FR-4 (or other fiberglass reinforced epoxy laminates) or Duroid.

In an embodiment, antennas 101 and 102 are microstrip patch antennas having a half wave length antenna with the wave length an inversely known relation to the frequency of operation scaled by the speed of light in the medium.

In an alternate embodiment, antennas 101 and 102 are quarter wave length microstrip antennas. In an embodiment, antennas 101 and 102 are Planar inverted F-antennas (PIFA) which is a particular type of quarter wave length microstrip antenna with reduced size compared to half wave length antennas. The overall antenna length is approximately a quarter wave length at an operating frequency with an option of having multiple branches originating from a feed point in order to cover more than one frequency band. PIFA antennas may have a shorting point located close to an antenna feed point in order to provide a shunt inductance to match an antenna to 50 ohm system impedance. In an embodiment, shorting elements 101*a* for antenna 101 and shorting element 102*a* for antennas 102, as illustrated in FIG. 1, provide this function.

In an embodiment, substrate 100 having antennas 101 and 102 are PIFA antennas operating in a Many Input Many Output (MIMO) computing device. In a typical MIMO computing device, isolation between two antennas typically depends upon several factors.

For example, physical separation between antennas provides isolation. The further apart the antennas; higher the isolation typically.

Polarization discrimination may also provide isolation. Two antennas arranged in an orthogonal manner may have orthogonal polarizations, which increases the isolation level between them.

In embodiments, physical separation may not be increased due to computing device space constraints. Polarization discrimination may provide isolation up to a certain extent (depending on the antenna polarization purity) which may not be enough in particular embodiments. In order to provide further antenna isolation, an external element, or parasitic element 103 is disposed between antennas 101 and 102. In an embodiment, parasitic element 103 is a metallic material, printed on PCB 200 that is directly connected to the ground plane 301 and has an overall length similar to a quarter wave length at a desired high isolation frequency.

FIG. 2 illustrates antennas 101 and 102, PIFA antennas in an embodiment, arranged in an orthogonal manner that exploits polarization discrimination. A parasitic element 103 is connected to a ground plane 301 and disposed between antennas 101 and 102 to provide further isolation. PCB 200 disposing antennas 101 and 102 is positioned on top of a larger metal chassis 201 with an antenna keep out area 202 overhanging or extending from perpendicular metal chassis sides' 201*a-b*. In an embodiment, PCB 200 extends beyond perpendicular metal chassis sides' 201*a-b* by approximately 10.6 mm. The dotted line and sides 104 and 105 define an antenna keep out area 202 in an embodiment. In an embodiment, an antenna keep out area 202 is approximately 8 mm from respective edges of sides 104 and 105. In an embodiment, antenna keep out area 202 is not positioned over metal chassis 201

Due to parasitic element 103 proximity with antennas 101 and 102, currents are induced into parasitic element 103. Some of this induced current resonating at a frequency close to 2.4 GHz is then re-radiated back into space. The electric fields from the antennas 101 and 102 and electric fields from parasitic element 103 are added together to form the total electric field. An electric field contribution from parasitic element 103 may add with electric fields from antennas 101 and 102 in a constructive or destructive manner for different regions of space. When this addition is destructive, the total electric field at a specific point of space is zero. When this region of the space happens to be the feed point of the opposite antenna, then there is a minimum coupling condition between antennas 101 and 102.

In alternate embodiments, additional antennas operating in different frequency bands and matching parasitic elements may be used. For example, a third antenna may be disposed on side 108 across from antenna 101 that radiates and receives signals at a different frequency than the 2.4 GHz and 5 GHz frequency bands. An additional parasitic element may be disposed between the additional antenna and antenna 102 to provide an additional electric isolation field that provides further isolation for the three antennas (101, 102 and additional antenna on side 108). In embodiments, the additional parasitic element may be disposed on side 104 and/or 108.

In still further embodiments, n antennas operating at n frequency bands with n−1 parasitic elements may be configured on a substrate to exploit polarization discrimination and provide additional electric isolation fields from the n−1 parasitic elements that further isolate the n antennas.

Figure 4A:
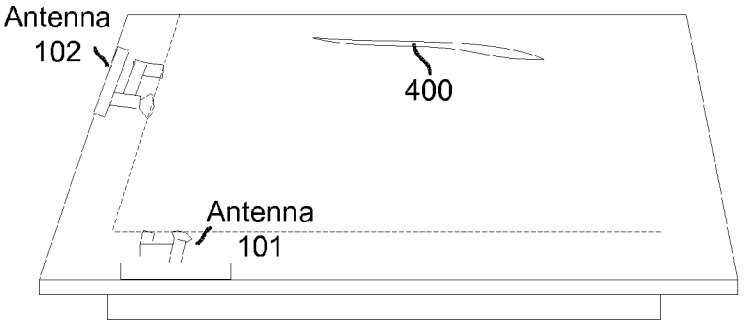
FIGS. 4A-D illustrates particular electric fields over a PCB with and without a parasitic element.
Figure 4B:
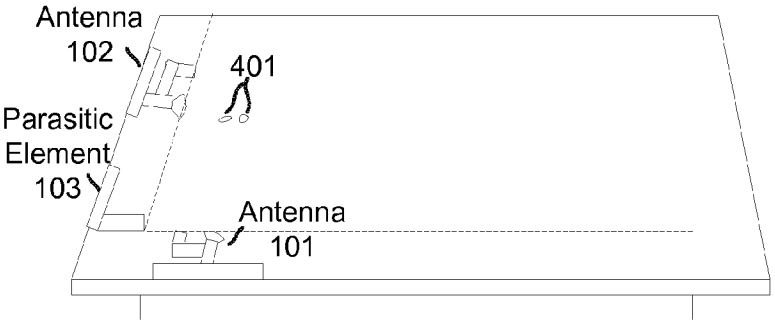
Figure 4C:
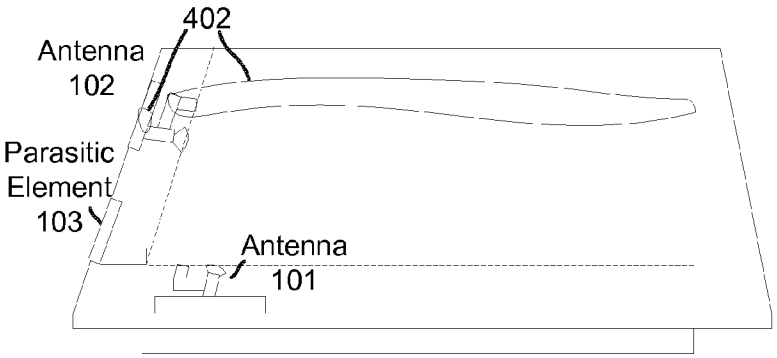
Figure 4D:
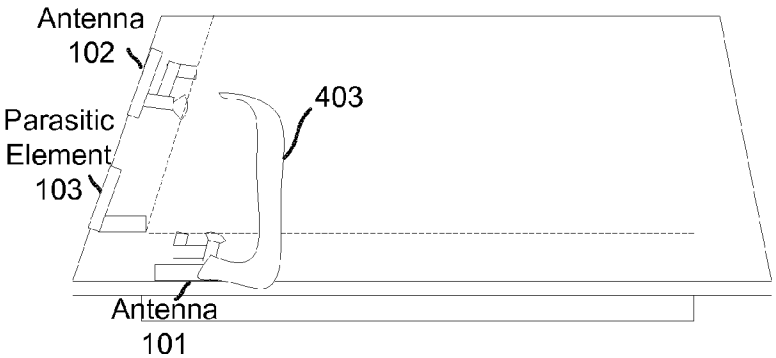

FIGS. 4A-D illustrates electric fields over PCB 200 before and after introducing a parasitic element 103. FIG. 4A illustrates an electrical field over PCB 200 without a parasitic element 103 when a 2.4 GHz signal is input to antenna 101. FIG. 4B illustrates an electrical field over PCB 200 without a parasitic element 103 when a 2.4 GHz signal is input to antenna 102. FIG. 4C illustrates an electrical field over PCB 200 with a parasitic element 103 when a 2.4 GHz signal is input to antenna 101. FIG. 4D illustrates an electrical field over PCB 200 with a parasitic element 103 when a 2.4 GHz signal is input to antenna 102.

Null areas 400-403 shown in FIGS. 4A-D illustrate a cancelling electric field or electric isolation field introduced by parasitic element 103. As one of ordinary skill in the art would appreciate, null areas 400-403 illustrate the most concentrated null areas. Electric isolation fields also extend radially from null areas 400-403 and gradually dissipate. When a parasitic element 103 is used as illustrated in FIGS. 4C-D, relatively larger null areas 402 and 403 are formed near feed points 101*b* and 102*b* of antennas 101 and 102. In particular, an electric field created over PCB 200 by one antenna forms a null area in an area surrounding the opposite antenna feed point (for example null areas 402 or 403). These null areas 402-403 mean that parasitic element 103 has created cancelling electric field interference in the opposite's antenna feed point region that is helping to improve isolation between antennas 101 and 102.

In comparison, FIGS. 4A-B illustrates null regions 400-401 over PCB 200 when a parasitic element 103 is not used. Null areas 400-401 are not as large and as near antenna feed points as null areas 402-403 formed when a parasitic element is used as illustrated in FIGS. 4A-B. Because the null areas 402-403 are not as large and near antenna feed points, less isolation between the antennas is created in an embodiment.

Figure 5A:
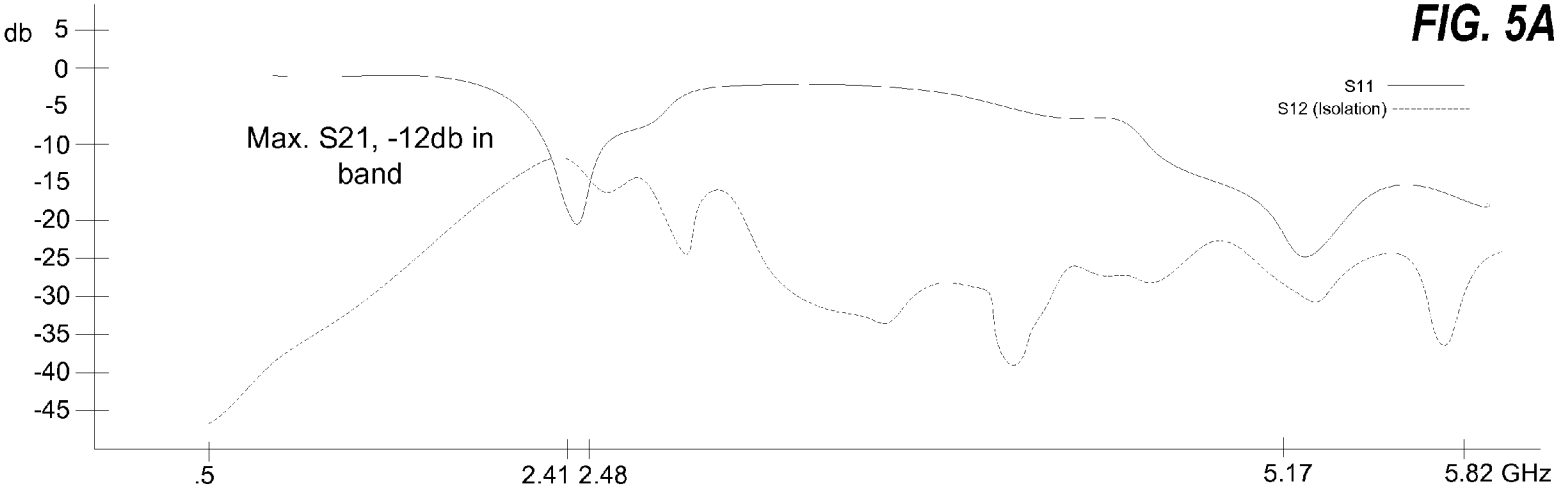
FIGS. 5A-B illustrates isolation between antennas with and without a parasitic element using a transmission scattering parameter, S12.
Figure 5B:
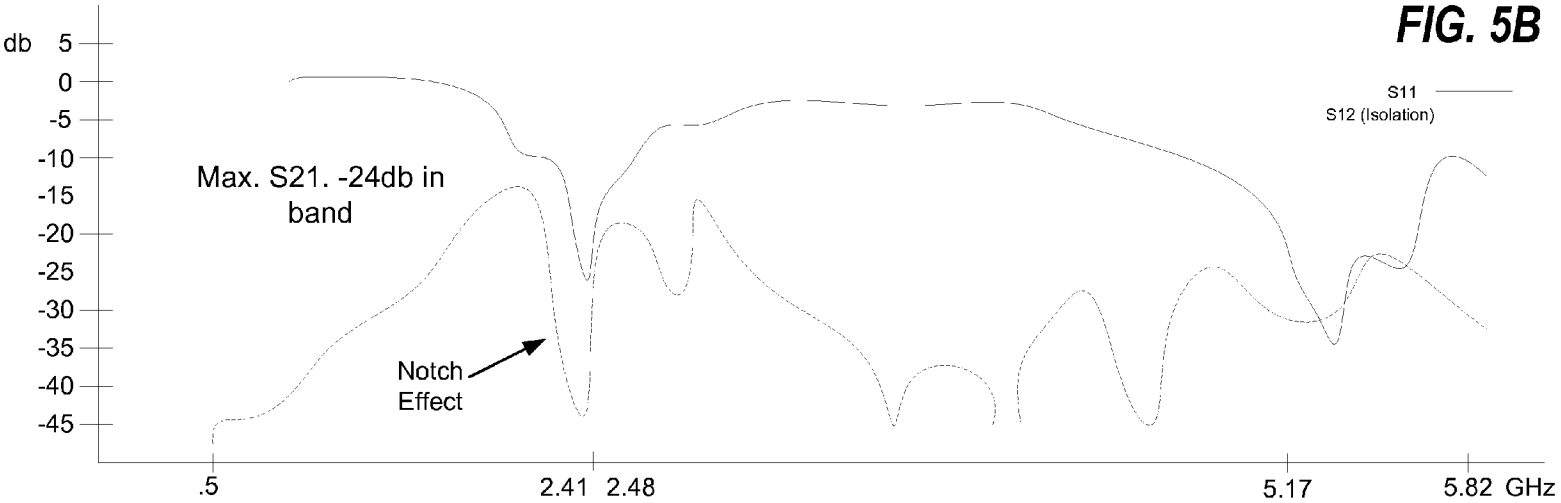

FIGS. 5A-B illustrates isolation between antennas 101 and 102 using a transmission scattering parameter, S12. Parameter S12 measures how much energy radiated by one antenna is absorbed by the other antenna. The lower the S12 parameter, the more isolated antennas are. In an embodiment, isolation between antennas has a S12 parameter of less than −20 db though all different frequency bands, such as the 2.4 GHz band and the 5 GHz band.

FIG. 5A illustrates isolation between antennas 101 and 102 without a parasitic element 103. The dotted line represents the S12 parameter and the solid line represents the S11 antenna matching parameter. As can be seen, the maximum negative S12 parameter occurs in the 2.4 GHz band (2.41 GHz to 2.48 GHz) at −12 db.

In contrast, FIG. 5B illustrates isolation between antennas 101 and 102 with a parasitic element 103. The dotted line represents the S12 parameter and the solid line represents the S11 antenna matching parameter. As can be seen in FIG. 5B, a dip notch (notch effect) in S21 (increase in isolation) around the 2.4 GHz band is created by the destructive electronic field interference of parasitic element 103. When using parasitic element 103, lower than −20 db is seen for both, the 2.4 GHz and 5 GHz bands. The maximum negative S12 parameter occurs in the 2.4 GHz band at −24 db as compared to −12 db when not using parasitic element 103 shown in FIG. 5A.

In an embodiment in which a notch or higher isolation is needed in the 5 GHz band, a second parasitic element may be used to resonate at a frequency close to 5 GHz.

Figure 5C:
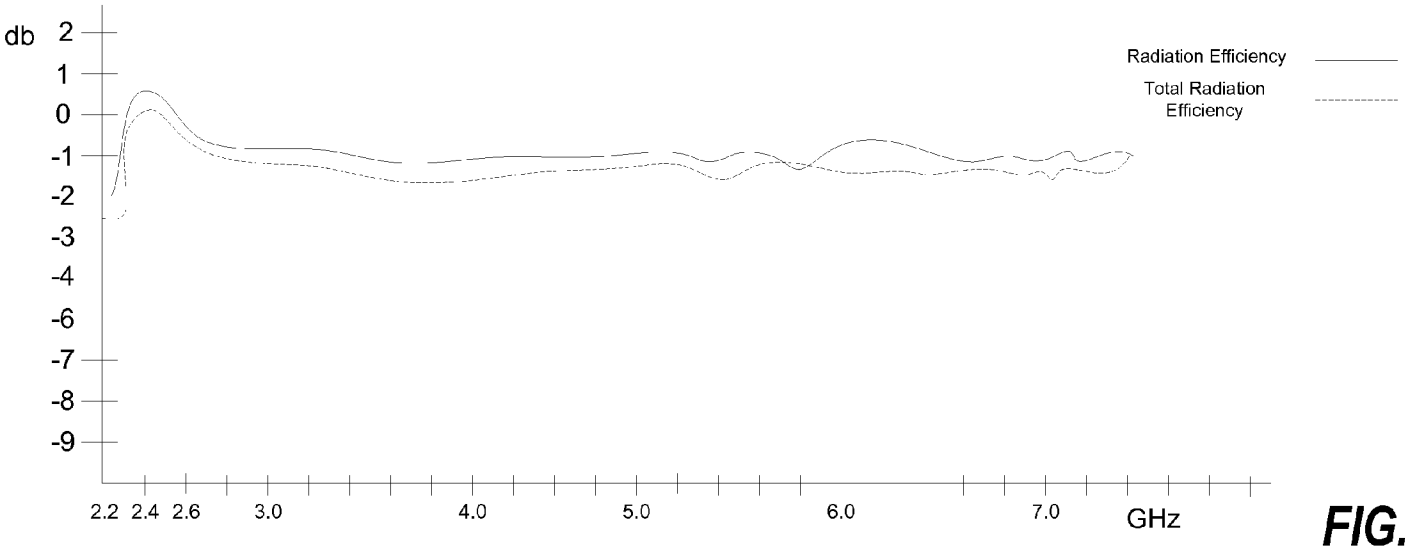
FIGS. 5C-D illustrates antenna efficiencies using a parasitic element.
Figure 5D:
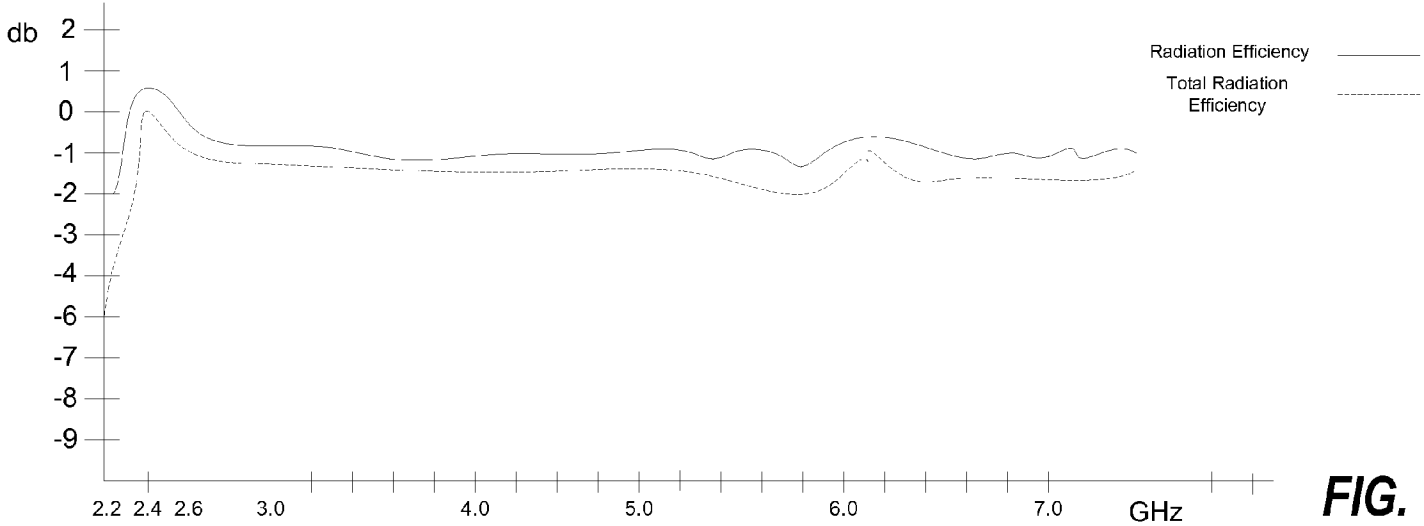

FIGS. 5C-D illustrate that the use of parasitic element 103 does not significantly impact the radiated performance of the antennas. Performance is typically measured in terms of antenna efficiency. This parameter measures how much of the power injected into the antenna is radiated into space. As a ratio, the parameter may also be expressed in db units. The closer the antenna efficiency parameter is to 0 db the more energy the antenna radiates. A −3 db antenna efficiency means that the antenna is losing approximately 50% of the power in terms of heat dissipation.

FIG. 5C illustrates radiation efficiency for antenna 101 shown as a solid line and total radiation efficiency for antenna 101 shown as a dashed line. Similarly, FIG. 5D illustrates radiation efficiency for antenna 102 shown as a solid line and total radiation efficiency for antenna 102 shown as a dashed line. As can be seen, both radiation efficiency and total radiation efficiency for both antennas 101 and 102 are high in the 2.4 GHz and 5.0 GHz bands that indicate most of the power injected is radiated into space. In particular, antennas 101 and 102 efficiencies are higher than −2 db in the 2.4 GHz and 5.0 GHz bands. This indicates a good over the air performance even with these highly isolated antennas.

Figure 7:
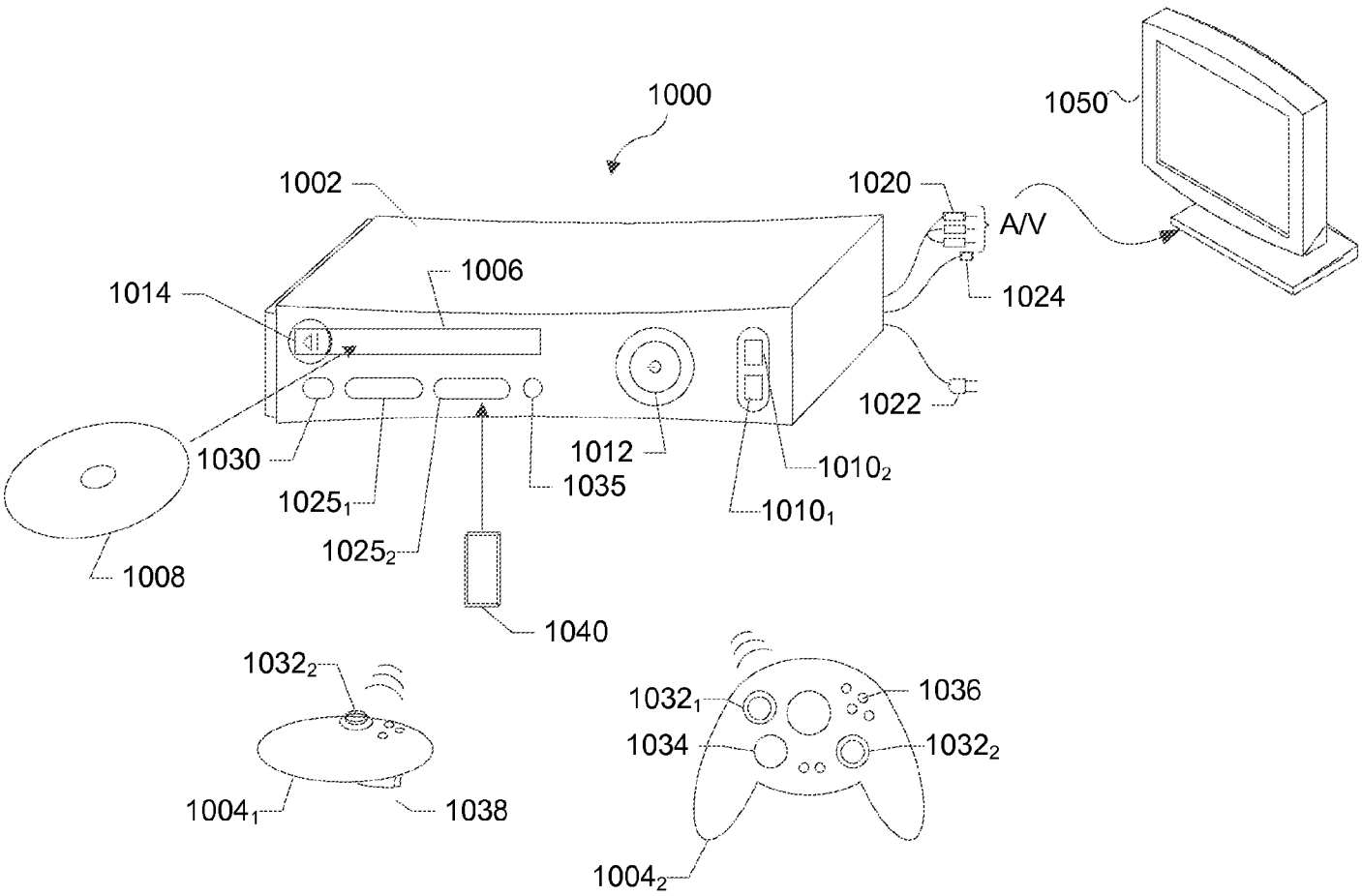
FIG. 7 is an isometric view of an exemplary gaming and media system.
Figure 8:
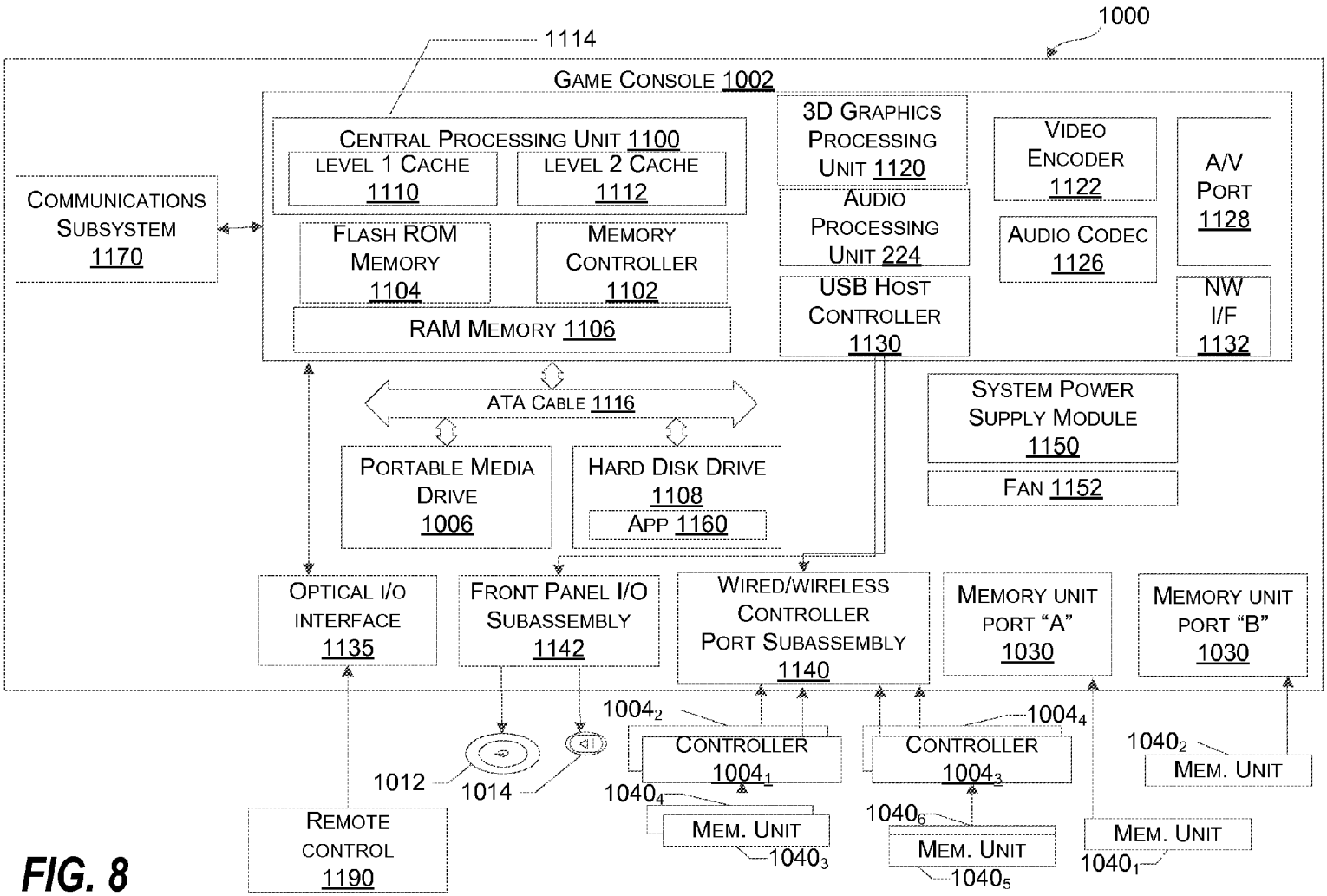
FIG. 8 is an exemplary functional block diagram of components of the gaming and media system.

In an embodiment, substrate 100 with antennas 101 and 102 are included in a computing device such as a video game console and/or media console and illustrated in FIGS. 7 and 8. In an embodiment, substrate 100 with antennas 101 and 102 are used to access a network and/or the Internet via a console. In alternate embodiments, substrate 100 with antennas 101 and 102 may be included in at least a cell phone, mobile device, embedded system, laptop computer, desktop computer, server and/or datacenter.

Figure 6:
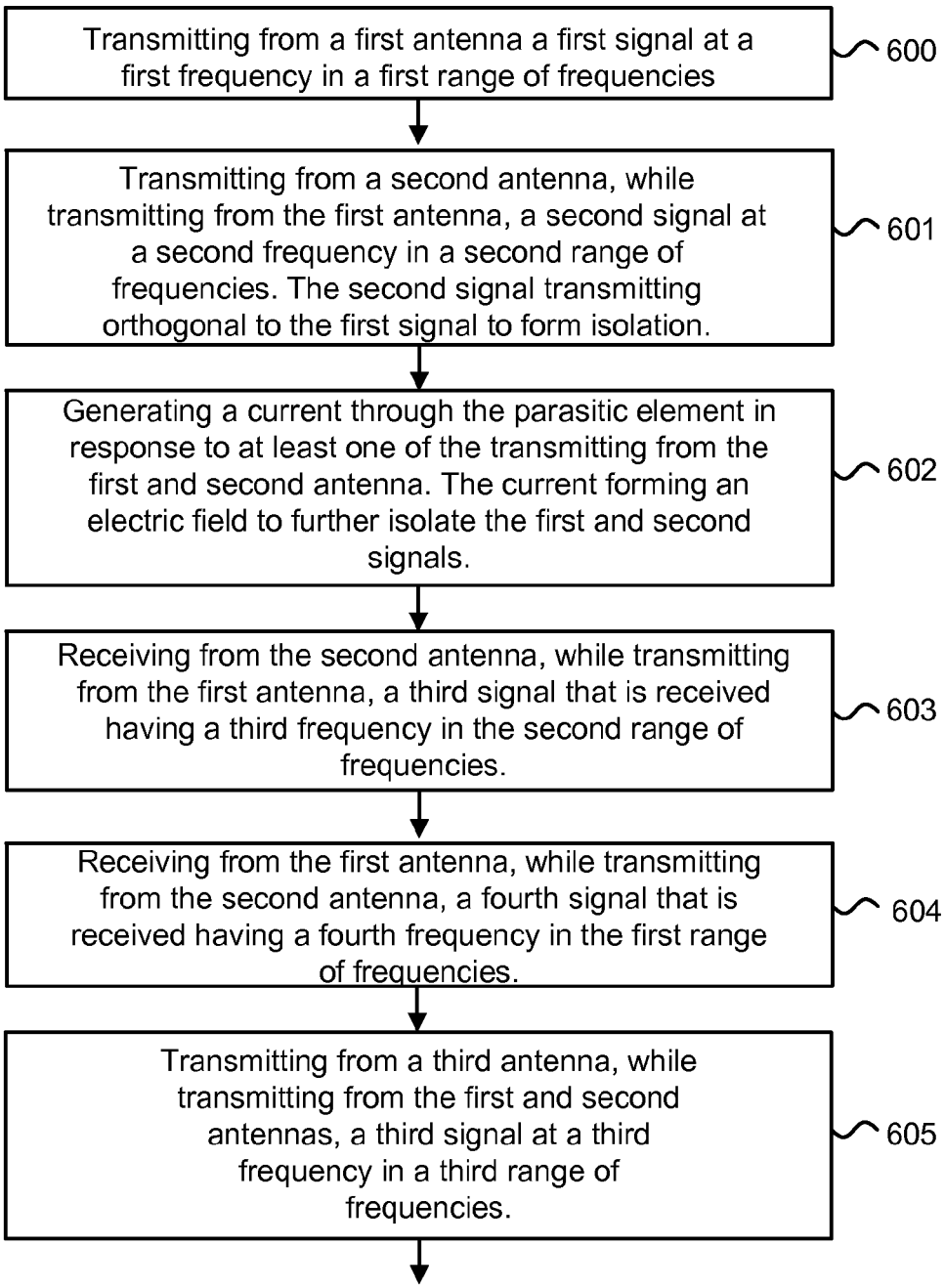
FIG. 6 illustrates operating a multi-band antenna with high isolation.

FIG. 6 is a flow chart for operating a dual band antenna with high isolation according to various embodiments. In embodiments, steps illustrated in FIGS. 6A-C represent the operation of hardware (e.g., antenna, processors, memories, cells, circuits), software (e.g., operating systems, software components, applications, drivers, machine/processor executable instructions), or a user, singly or in combinations. As one of ordinary skill in the art would understand, embodiments may include less or more steps shown. In various embodiments, steps illustrated may be completed sequentially, in parallel or in a different order as illustrated.

In an embodiment, a method shown FIG. 6 illustrates an operation of antennas 101 and 102 as well as parasitic element 103.

Step 600 represents transmitting from a first antenna a first signal at a first frequency in a first range of frequencies. For example, antenna 101 transmits a signal a frequency band.

Step 601 represents transmitting from a second antenna, while transmitting from the first antenna, a second signal at a second frequency in a second range of frequencies. The second signal transmitting orthogonal to the first signal for form isolation. In an embodiment, antenna 102 transmits the second signal.

Step 602 represents generating a current through the parasitic element in response to at least one of the transmitting from the first and second antenna. The current forming an electric field to further isolate the first and second signals. In an embodiment, a parasitic element 103 is used.

Step 603 illustrates receiving from the second antenna, while transmitting from the first antenna, a third signal that is received having a third frequency in the second range of frequencies.

Step 604 illustrates receiving from the first antenna, while transmitting from the second antenna, a fourth signal that is received having a fourth frequency in the first range of frequencies.

Step 605 illustrates transmitting from a third antenna, while transmitting from the first and second antennas, a third signal at a third frequency in a third range of frequencies.

This method may include other steps, actions and/or details that are not discussed in this method overviews illustrated in FIG. 6. Other steps, actions and/or details described herein may be a part of the method, depending on the implementation.

In an embodiment, computing device include substrate 100 having antennas 101 and 102 and parasitic element 103 may be, but is not limited to, a video game and/or media console. FIG. 7 will now be used to describe an exemplary video game and media console, or more generally, will be used to describe an exemplary gaming and media system 1000 that includes a game and media console. The following discussion of FIG. 7 is intended to provide a brief, general description of a suitable computing device with which concepts presented herein may be implemented. It is understood that the system of FIG. 7 is by way of example only. In further examples, embodiments describe herein may be implemented using a variety of client computing devices, either via a browser application or a software application resident on and executed by a client computing device. As shown in FIG. 7, a gaming and media system 1000 includes a game and media console (hereinafter "console") 1002. In general, the console 1002 is one type of client computing device. The console 1002 is configured to accommodate one or more wireless controllers, as represented by controllers $\mathbf{1004}_1$ and $\mathbf{1004}_2$. The console 1002 is equipped with an internal hard disk drive and a portable media drive 1006 that support various forms of portable storage media, as represented by an optical storage disc 1008. Examples of suitable portable storage media include DVD, CD-ROM, game discs, and so forth. The console 1002 also includes two memory unit card receptacles $\mathbf{1025}_1$ and $\mathbf{1025}_2$, for receiving removable flash-type memory units 1040. A command button 1035 on the console 1002 enables and disables wireless peripheral support.

As depicted in FIG. 7, the console 1002 also includes an optical port 1030 for communicating wirelessly with one or more devices and two USB ports $\mathbf{1010}_1$ and $\mathbf{1010}_2$ to support a wired connection for additional controllers, or other peripherals. In some implementations, the number and arrangement of additional ports may be modified. A power button 1012 and an eject button 1014 are also positioned on the front face of the console 1002. The power button 1012 is selected to apply power to the game console, and can also provide access to other features and controls, and the eject button 1014 alternately opens and closes the tray of a portable media drive 1006 to enable insertion and extraction of an optical storage disc 1008.

The console 1002 connects to a television or other display (such as display 1050) via A/V interfacing cables 1020. In one implementation, the console 1002 is equipped with a dedicated A/V port configured for content-secured digital communication using A/V cables 1020 (e.g., A/V cables suitable for coupling to a High Definition Multimedia Interface "HDMI" port on a high definition display 1050 or other display device). A power cable 1022 provides power to the game console. The console 1002 may be further configured with broadband capabilities, as represented by a cable or modem connector 1024 to facilitate access to a network, such as the Internet. The broadband capabilities can also be provided wirelessly, through a broadband network such as a wireless fidelity (Wi-Fi) network.

Each controller 1004 is coupled to the console 1002 via a wired or wireless interface. In the illustrated implementation, the controllers 1004 are USB-compatible and are coupled to the console 1002 via a wireless or USB port 1010. The console 1002 may be equipped with any of a wide variety of user interaction mechanisms. In an example illustrated in FIG. 7, each controller 1004 is equipped with two thumb sticks $\mathbf{1032}_1$ and $\mathbf{1032}_2$, a D-pad 1034, buttons 1036, and two triggers 1038. These controllers are merely representative, and other known gaming controllers may be substituted for, or added to, those shown in FIG. 7.

In an embodiment, a user may enter input to console 1002 by way of gesture, touch or voice. In an embodiment, optical I/O interface 1135 receives and translates gestures of a user. In another embodiment, console 1002 includes a natural user interface (NUI) to receive and translate voice and gesture inputs from a user. In an alternate embodiment, front panel subassembly 1142 includes a touch surface and a microphone for receiving and translating a touch or voice, such as a voice command, of a user.

In one implementation, a memory unit (MU) 1040 may also be inserted into the controller 1004 to provide additional and portable storage. Portable MUs enable users to store game parameters for use when playing on other consoles. In this implementation, each controller is configured to accommodate two MUs 1040, although more or less than two MUs may also be employed.

The gaming and media system 1000 is generally configured for playing games (such as video games) stored on a memory medium, as well as for downloading and playing games, and reproducing pre-recorded music and videos, from both electronic and hard media sources. With the different storage offerings, titles can be played from the hard disk drive, from an optical storage disc (e.g., 1008), from an online source, or from MU 1040. Samples of the types of media that gaming and media system 1000 is capable of playing include:

Game titles played from CD and DVD discs, from the hard disk drive, or from an online streaming media source.

Digital music played from a CD in portable media drive 1006, from a file on the hard disk drive (e.g., music in a media format), or from online streaming media sources.

Digital audio/video played from a DVD disc in portable media drive 1006, from a file on the hard disk drive (e.g., Active Streaming Format), or from online streaming sources.

During operation, the console 1002 is configured to receive input from controllers 1004 and display information on the display 1050. For example, the console 1002 can display a user interface on the display 1050 to allow a user to select a game using the controller 1004 and display state solvability information as discussed below.

FIG. 8 is a functional block diagram of the gaming and media system 1000 and shows functional components of the gaming and media system 1000 in more detail. The console 1002 has a CPU 1100, and a memory controller 1102 that facilitates processor access to various types of memory, including a flash ROM 1104, a RAM 1106, a hard disk drive 1108, and the portable media drive 1006. In one implementation, the CPU 1100 includes a level 1 cache 1110 and a level 2 cache 1112, to temporarily store data and hence reduce the number of memory access cycles made to the hard drive 1108, thereby improving processing speed and throughput. In an embodiment, CPU 1100 and memory controller 1102 correspond to processor 103 and engine 105 while RAM 1106 corresponds to memory 102 in embodiments.

The CPU 1100, the memory controller 1102, and various memory devices are interconnected via one or more buses. The details of the bus that is used in this implementation are not particularly relevant to understanding the subject matter of interest being discussed herein. However, it will be understood that such a bus might include one or more of serial and parallel buses, a memory bus, a peripheral bus, and a processor or local bus, using any of a variety of bus architectures. By way of example, such architectures can include an Industry Standard Architecture (ISA) bus, a Micro Channel Architecture (MCA) bus, an Enhanced ISA (EISA) bus, a Video Electronics Standards Association (VESA) local bus, and a Peripheral Component Interconnects (PCI) bus also known as a Mezzanine bus.

In one implementation, the CPU 1100, the memory controller 1102, the ROM 1104, and the RAM 1106 are integrated onto a common module 1114. In this implementation, the ROM 1104 is configured as a flash ROM that is connected to the memory controller 1102 via a PCI bus and a ROM bus (neither of which are shown). The RAM 1106 is configured as multiple Double Data Rate Synchronous Dynamic RAM (DDR SDRAM) modules that are independently controlled by the memory controller 1102 via separate buses. The hard disk drive 1108 and the portable media drive 1006 are shown connected to the memory controller 1102 via the PCI bus and an AT Attachment (ATA) bus 1116. However, in other implementations, dedicated data bus structures of different types can also be applied in the alternative.

In an embodiment, RAM 1106 may represent one or more processor readable memories. In an embodiment, RAM 1106 may be a Wide I/O DRAM. Alternatively, RAM 1106 may be Low Power Double Data Rate 3 dynamic random access memory (LPDDR3 DRAM) memory (also known as Low Power DDR, mobile DDR (MDDR) or mDDR).

In embodiments, RAM 1106 includes one or more arrays of memory cells in an IC disposed on a semiconductor substrate. In an embodiment, RAM 1106 is included in an integrated monolithic circuit housed in a separately packaged device than CPU 1100.

RAM 1106 may be replaced with other types of volatile memory that include at least dynamic random access memory (DRAM), molecular charge-based (ZettaCore) DRAM, floating-body DRAM and static random access memory ("SRAM"). Particular types of DRAM include double data rate SDRAM ("DDR"), or later generation SDRAM (e.g., "DDRn").

ROM 1104 may likewise be replaced with other types of non-volatile memory including at least types of electrically erasable program read-only memory ("EEPROM"), FLASH (including NAND and NOR FLASH), ONO FLASH, magneto resistive or magnetic RAM ("MRAM"), ferroelectric RAM ("FRAM"), holographic media, Ovonic/phase change, Nano crystals, Nanotube RAM (NRAM-Nantero), MEMS scanning probe systems, MEMS cantilever switch, polymer, molecular, nano-floating gate and single electron.

A three-dimensional graphics processing unit 1120 and a video encoder 1122 form a video processing pipeline for high speed and high resolution (e.g., High Definition) graphics processing. Data are carried from the graphics processing unit 1120 to the video encoder 1122 via a digital video bus. An audio processing unit 1124 and an audio codec (coder/decoder) 1126 form a corresponding audio processing pipeline for multi-channel audio processing of various digital audio formats. Audio data are carried between the audio processing unit 1124 and the audio codec 1126 via a communication link. The video and audio processing pipelines output data to an A/V (audio/video) port 1128 for transmission to a television or other display. In the illustrated implementation, the video and audio processing components 1120-1128 are mounted on the module 1114.

FIG. 8 shows the module 1114 including a USB host controller 1130 and a network interface 1132. The USB host controller 1130 is shown in communication with the CPU 1100 and the memory controller 1102 via a bus (e.g., PCI bus) and serves as host for the peripheral controllers $\mathbf{1004}_1$-$\mathbf{1004}_4$. The network interface 1132 provides access to a network (e.g., Internet, home network, etc.) and may be any of a wide variety of various wire or wireless interface components including an Ethernet card, a modem, a wireless access card, a Bluetooth module, a cable modem, and the like.

In an embodiment, PCB 200 having PIFA antennas 101 and 102 as well as a parasitic element 103, as illustrated in FIG. 2, is included in network interface 1132. In an embodiment, network interface 1132 includes a processor or transceiver that outputs signals to access a network (or the Internet) to PIFA antennas 101 and 102 via cables 106 and 107. In an embodiment, the processor may be disposed on PCB 200. In an embodiment, signals to access the Internet may include one or more signals representing Transmission Control Protocol/Internet Protocol (TCP/IP) information. In alternate embodiments, a processor outputs signals that include a uniform resource locator (URL) also known as web address to access an Internet resource.

In the implementation depicted in FIG. 8, the console 1002 includes a controller support subassembly 1140 for supporting the four controllers $\mathbf{1004}_1$-$\mathbf{1004}_4$. The controller support subassembly 1140 includes any hardware and software components to support wired and wireless operation with an external control device, such as for example, a media and game controller. A front panel I/O subassembly 1142 supports the multiple functionalities of power button 1012, the eject button 1014, as well as any LEDs (light emitting diodes) or other indicators exposed on the outer surface of console 1002. Subassemblies 1140 and 1142 are in communication with the module 1114 via one or more cable assemblies 1144. In other implementations, the console 1002 can include additional controller subassemblies. The illustrated implementation also shows an optical I/O interface 1135 that is configured to send and receive signals that can be communicated to the module 1114.

The MUs $\mathbf{1040}_1$ and $\mathbf{1040}_2$ are illustrated as being connectable to MU ports "A" $\mathbf{1030}_1$ and "B" $\mathbf{1030}_2$ respectively. Additional MUs (e.g., MUs $\mathbf{1040}_3$-$\mathbf{1040}_6$) are illustrated as being connectable to the controllers $\mathbf{1004}_1$ and $\mathbf{1004}_3$, i.e., two MUs for each controller. The controllers $\mathbf{1004}_2$ and $\mathbf{1004}_4$ can also be configured to receive MUs. Each MU 1040 offers additional storage on which games, game parameters, and other data may be stored. In some implementations, the other data can include any of a digital game component, an executable gaming application, an instruction set for expanding a gaming application, and a media file. When inserted into the console 1002 or a controller, the memory controller 1102 can access the MU 1040.

A system power supply module 1150 provides power to the components of the gaming system 1000. A fan 1152 cools the circuitry within the console 1002.

An application 1160 comprising processor readable instructions is stored on the hard disk drive 1108. When the console 1002 is powered on, various portions of the application 1160 are loaded into RAM 1106, and/or caches 1110 and 1112, for execution on the CPU 1100, wherein the application 1160 is one such example. Various applications can be stored on the hard disk drive 1108 for execution on CPU 1100. In an embodiment, CPU 1100 executes application 1160 having processor readable instructions that causes signals to be output to antennas 101 and 102.

The console 1002 is also shown as including a communication subsystem 1170 configured to communicatively couple the console 1002 with one or more other computing devices (e.g., other consoles). The communication subsystem 1170 may include wired and/or wireless communication devices compatible with one or more different communication protocols. As non-limiting examples, the communication subsystem 1170 may be configured for communication via a wireless telephone network, or a wired or wireless local- or wide-area network. In some embodiments, the communication subsystem 1170 may allow the console 1002 to send and/or receive messages to and/or from other devices via a network such as the Internet. In specific embodiments, the communication subsystem 1170 can be used to communicate with a coordinator and/or other computing devices, for sending download requests, and for effecting downloading and uploading of digital content. More generally, the communication subsystem 1170 can enable the console 1002 to participate on peer-to-peer communications.

The gaming and media system 1000 may be operated as a standalone system by simply connecting the system to display 1050 (FIG. 7), a television, a video projector, or other display device. In this standalone mode, the gaming and media system 1000 enables one or more players to play games, or enjoy digital media, e.g., by watching movies, or listening to music. However, with the integration of broadband connectivity made available through network interface 1132, or more generally the communication subsystem 1170, the gaming and media system 1000 may further be operated as a participant in a larger network gaming community, such as a peer-to-peer network.

The above described console 1002 is just one example of a computing device having a substrate 100 and antennas 101 and 102 as well as parasitic element 103 as illustrated in FIG. 1. As was explained above, there are various other types of computing devices with which embodiments described herein can be used.

Figure 9:
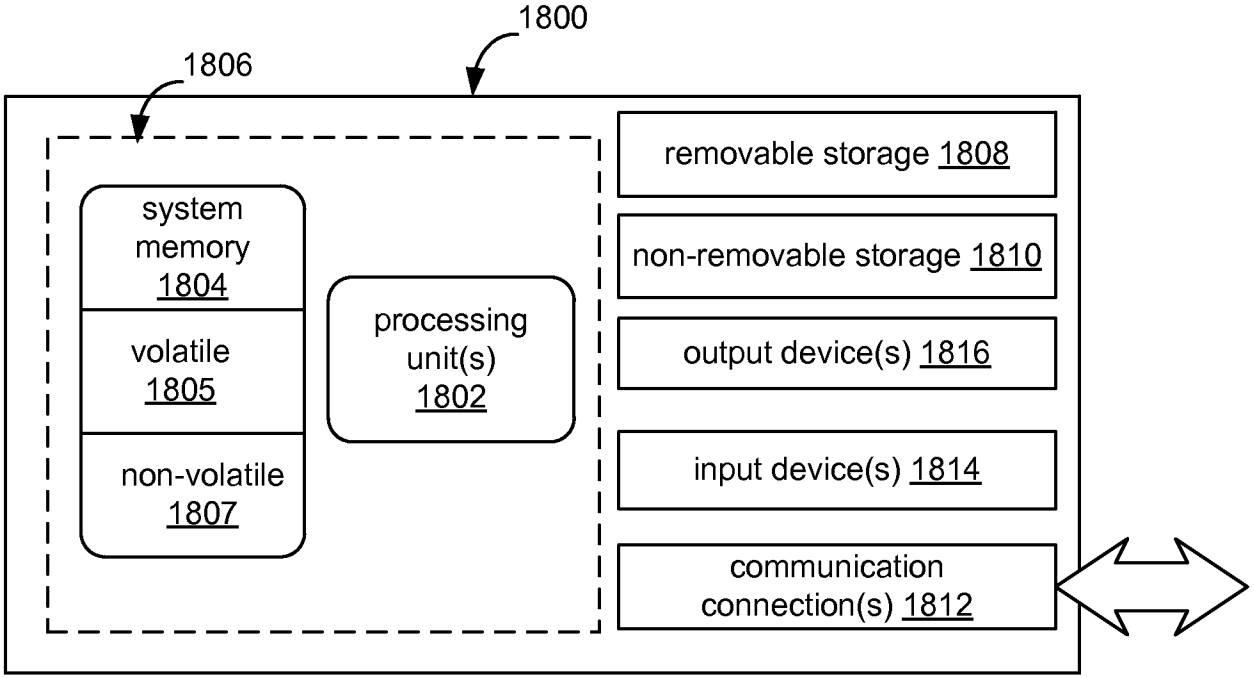
FIG. 9 illustrates is a block diagram of one embodiment of a network accessible computing device.

FIG. 9 is a block diagram of one embodiment of a computing device having a substrate 100 and antennas 101 and 102 as well as parasitic element 103 as illustrated in FIG. 1. In its most basic configuration, computing device 1800 typically includes one or more processing units 1802 including one or more CPUs and one or more GPUs. Depending on the exact configuration and type of computing device, system memory 1804 may include volatile memory 1805 (such as RAM), non-volatile memory 1807 (such as ROM, flash memory, etc.) or some combination of the two. This most basic configuration is illustrated in FIG. 9 by dashed line 1806. Additionally, device 1800 may also have additional features/functionality. For example, device 1800 may also include additional storage (removable and/or non-removable) including, but not limited to, magnetic or optical discs or tape. Such additional storage is illustrated in FIG. 9 by removable storage 1808 and non-removable storage 1810.

Device 1800 may also contain communications connection(s) 1812 such as one or more network interfaces and transceivers that allow the device to communicate with other devices. Device 1800 may also have input device(s) 1814 such as keyboard, mouse, pen, voice input device, touch input device, gesture input device, etc. Output device(s) 1816 such as a display, speakers, printer, etc. may also be included. These devices are well known in the art so they are not discussed at length here.

The foregoing detailed description of the inventive system has been presented for purposes of illustration and description. It is not intended to be exhaustive or to limit the inventive system to the precise form disclosed. Many modifications and variations are possible in light of the above teaching. The described embodiments were chosen in order to best explain the principles of the inventive system and its practical application to thereby enable others skilled in the art to best utilize the inventive system in various embodiments and with various modifications as are suited to the particular use contemplated. It is intended that the scope of the inventive system be defined by the claims appended hereto.

What is claimed is:

1. An apparatus comprising:

a ground plane on a first side of a substrate;

a first planar metallic antenna on a second side of the substrate;

a second planar metallic antenna on the second side of the substrate, wherein the first planar metallic antenna and the second planar metallic antenna are configured to have orthogonal polarization; and a planar metallic parasitic element disposed between the first and second planar metallic antennas on the second side of the substrate and configured to provide electrical isolation between the first and second planar metallic antennas, wherein the planar metallic parasitic element is in the same plane as the first planar metallic antenna and the second planar metallic antenna, said same plane being parallel to the ground plane, the planar metallic parasitic element is electrically connected to the ground plane.

2. The apparatus of claim 1, wherein the first planar metallic antenna comprises a first feed point and the second planar metallic antenna comprises a second feed point, wherein the planar metallic parasitic element is configured to generate a first electric isolation field at the first feed point when the second planar metallic antenna is transmitting within a certain frequency range and is configured to generate a second electric isolation field at the second feed point when the first planar metallic antenna is transmitting within the certain frequency range.

3. The apparatus of claim 1, wherein the first planar metallic antenna and the second planar metallic antenna are Planar inverted F-antennas (PIFA).

4. The apparatus of claim 3, wherein the planar metallic parasitic element is formed in the shape of a capital letter L.

5. The apparatus of claim 1, further comprising a metal chassis on which the substrate is mounted, the substrate having a first overhanging side extending beyond a first edge of the metal chassis, the substrate having a second overhanging side extending beyond a second edge of the metal chassis, wherein the first overhanging side of the substrate is adjacent to the second overhanging side of the substrate, wherein neither the first planar metallic antenna nor the second planar metallic antenna reside over metal.

6. The apparatus of claim 5, wherein the first overhanging side of the substrate and the second overhanging side of the substrate form a 90 degree corner.

7. The apparatus of claim 1, wherein the substrate comprises a printed circuit board.

8. A method of operating a multi-band wireless wide area network antenna apparatus, the method comprising:

transmitting a first signal at a first frequency in a first range of frequencies from a first planar metallic antenna, the first planar metallic antenna resides on a first side of a substrate, the substrate has a ground plane on a second side;

transmitting a second signal at a second frequency in a second range of frequencies from a second planar metallic antenna while transmitting from the first planar metallic antenna, the second planar metallic antenna resides on the first side of the substrate, the second signal transmitting orthogonal polarization to the first signal; and generating currents through a planar metallic parasitic element that resides on the first side of the substrate between the first planar metallic antenna and the second planar metallic antenna, the currents generated in response to the first signal, the currents causing the planar metallic parasitic element to create an electric field that provides electrical isolation between the first and second planar metallic antennas, wherein the planar metallic parasitic element is in the same plane as the first planar metallic antenna and the second planar metallic antenna, said same plane being parallel to the ground plane, the planar metallic parasitic element is electrically connected to the ground plane.

9. The method of claim 8, wherein the first planar metallic antenna comprises a first feed point and the second planar metallic antenna comprises a second feed point, the generating the currents through the planar metallic parasitic element comprises generating the electric isolation field at the second feed point when the first planar metallic antenna is transmitting within a certain frequency range.

10. The method of claim 9, further comprising:

generating currents through the planar metallic parasitic element when the second planar metallic antenna is transmitting within the certain frequency range to cause an isolation field at the first feed point.

11. The method of claim 8, wherein the first planar metallic antenna comprises a first feed point and the second planar metallic antenna comprises a second feed point, the generating the currents through the planar metallic parasitic element causes an electric field that combines destructively with an electric field of the first planar metallic antenna to minimize a resultant electric field in the second feed point.

12. The method of claim 11, further comprising:

generating currents through the planar metallic parasitic element when the second planar metallic antenna is transmitting the second signal to cause an isolation field at the first feed point.

13. The method of claim 12, wherein the first range of frequencies include frequencies between 2.41 GHz and 2.48 GHz and the second range of frequencies between 5.17 GHz and 5.82 GHz.

14. The method of claim 8, wherein the substrate is mounted on a metal chassis, the substrate having a first overhanging side extending beyond a first edge of the metal chassis, the substrate having a second overhanging side extending beyond a second edge of the metal chassis, wherein the first overhanging side of the substrate is adjacent to the second overhanging side of the substrate, wherein neither the first planar metallic antenna nor the second planar metallic antenna reside over metal.

15. An apparatus comprising:

a printed circuit board having a first major side and a second major side;

a ground plane on the first major side of the printed circuit board;

a first metallic microstrip antenna on the second major side of the printed circuit board, the first metallic microstrip antenna configured to radiate a first signal in a first range of frequencies;

a second metallic microstrip antenna on the second major side of the printed circuit board, the second metallic microstrip antenna configured to radiate a second signal in a second range of frequencies, the second signal radiates orthogonal to the first signal; and a planar metallic parasitic element disposed between the first and second metallic microstrip antennas on the second side of the printed circuit board and configured to provide electrical isolation between the first and second metallic microstrip antennas, wherein the planar metallic parasitic element is in the same plane as the first metallic microstrip antenna and the second metallic microstrip antenna, said same plane being parallel to the ground plane, the planar metallic parasitic element is electrically connected to the ground plane.

16. The apparatus of claim 15, wherein the first metallic microstrip antenna comprises a first feed point, wherein the second metallic microstrip antenna comprises a second feed point, wherein the planar metallic parasitic element is configured to:

generate an electrical isolation field at the second feed point in response to the first metallic microstrip antenna radiating the first signal.

17. The apparatus of claim 16, wherein the planar metallic parasitic element is further configured to:

generate an electrical isolation field at the first feed point in response to the second metallic microstrip antenna radiating the second signal.

18. The apparatus of claim 17, wherein the first range of frequencies include frequencies between 2.41 GHz and 2.48 GHz and the second range of frequencies between 5.17 GHz and 5.82 GHz.

19. The apparatus of claim 18, wherein a keep out area for the first and second antennas is not disposed over the rectangular metal chassis.

20. The apparatus of claim 15, wherein the ground plane is coupled to a rectangular metal chassis having a first side perpendicular to the ground plane and a second side perpendicular to the ground plane, wherein the printed circuit board extends from the first and second sides of the rectangular metal chassis.

21. The apparatus of claim 15, wherein the printed circuit board includes a material selected from one of FR-4 and Duroid that is at least partially disposed between the ground plane and the first and second microstrip antennas.

* * * * *